United States Patent [19]

Markovic

[11] Patent Number: 4,719,990

[45] Date of Patent: Jan. 19, 1988

[54] STEP LADDER FOR STAIRS

[76] Inventor: Branko Markovic, 758 East 38th Avenue, Vancouver, British Columbia, Canada, V5W 1J1

[21] Appl. No.: 900,980

[22] Filed: Aug. 27, 1986

[51] Int. Cl.[4] ..... E06C 1/28

[52] U.S. Cl. ..... 182/163; 182/24; 182/166

[58] Field of Search ..... 182/21, 22, 23, 24, 182/163, 166, 27, 165, 166

[56] References Cited

U.S. PATENT DOCUMENTS

| | | | |
|---|---|---|---|
| 383,243 | 5/1888 | Peacock | 182/24 |
| 646,347 | 3/1900 | Betty | 182/24 |
| 1,479,628 | 1/1924 | Seger | 182/24 |
| 1,648,844 | 11/1927 | Frisk | 182/163 |
| 1,936,508 | 11/1933 | Hanly et al. | 182/24 |
| 2,012,592 | 8/1935 | Skiba | 182/27 |
| 3,143,185 | 8/1964 | Wenger | 182/27 |
| 3,554,318 | 1/1971 | Knight | 182/27 |

FOREIGN PATENT DOCUMENTS

| | | | |
|---|---|---|---|
| 473534 | 3/1929 | Fed. Rep. of Germany | 182/163 |
| 1012696 | 4/1952 | France | 182/24 |
| 6223 | of 1901 | United Kingdom | 182/24 |

*Primary Examiner*—Reinaldo P. Machado
*Attorney, Agent, or Firm*—Carver & Co.

[57] ABSTRACT

A step ladder for stairs has a rear support member for providing a climbing structure, a front support member for retaining the rear support member in a substantially erect position, the front support member being hinged connected to the rear support member and including an upper portion with a bottom end and a lower portion, and a hinge assembly for hinged connecting the upper and lower portions together. The hinge assembly permits folding of the front support member so that the bottom end of the upper portion can rest on a first surface which is raised above a second surface whereupon the rear support member rests. The hinge assembly may have a first locking assembly to secure the upper and lower portions in an unfolded position and a second locking assembly to secure the upper and lower portions in a folded position.

8 Claims, 4 Drawing Figures

STEP LADDER FOR STAIRS

BACKGROUND OF THE INVENTION

1. Field of the Invention

The invention relates to a step ladder and, in particular, a step ladder which can be used in a conventional manner wherein the front and rear legs are located on the same surface or in an unconventional manner wherein the front legs are supported on a first surface raised above a second surface whereupon the rear legs are supported.

2. Prior Art

The invention has particular applications for use on staircases. Frequently, a person must do work above a staircase such as changing a lightbulb or painting the walls and/or ceiling of a stairwell. In these situations, a normal step ladder will not suffice because such ladders are only suited for use on flat surfaces.

Step ladders with telescoping front legs are available. U.S. Pat. No. 359,716 (Diltx), U.S. Pat. No. 1,312,725 (Gagnier), U.S. Pat. No. 2,200,535 (Brewer) and U.S. Pat. No. 4,412,599 (McCrudden) all relate to ladders which employ telescopic legs and which are capable of being set up on stairs. All of these devices however, have disadvantages which the present invention overcomes. Firstly, the telescoping legs of these devices can slip if not tightened enough. Secondly, the legs can be uneven if not carefully extended the same amount on each side of the ladder. In addition, telescopic legs would be subject to sticking if, for example, paint was to accidentally go between the telescoping portions of each legs.

SUMMARY OF THE INVENTION

The invention reduces difficulties and disadvantages of the prior art by providing a step ladder apparatus with hinged front legs.

An apparatus according to one aspect of the invention is for use on a flat surface or for use on a staircase or in other situations where it is useful to have the front legs of the ladder shorter than the rear legs. The apparatus includes rear support means for providing a climbing structure, front support means for retaining the rear support means in a substantially erect position, the front support means being hingedly connected to the rear support means and including an upper portion with a bottom end and a lower portion. There is hinge means for hingedly connecting the upper and lower portions together to permit folding of the front support means so that the bottom end of the upper portion can rest on a first surface raised above a second surface upon which the rear support means rests.

The hinge means may include a top member having a first recess to receive the upper portion and a bottom member having a second recess to receive the lower portion. Each of the members has opposite first and second sides, the members being hingedly connected together on the first said side of the members so as to permit the members to hinge between an unfolded position where the recesses are aligned and a folded position where the recesses are not aligned. Preferably the portions and their respective members are relatively positioned so that one of the portions projects beyond the member and the other portion provides a pocket to receive the projecting end of the member when the recesses are aligned.

Usefully, the apparatus can include first locking means for securing the members in the unfolded position. Additionally, the apparatus can include second locking means for securing the members in the folded position. The top member has a bottom edge and the bottom member has a top edge, the edges being in contact and extending at an acute angle with said first and second sides when the recesses are aligned. The top and bottom members may be rectangular tubes.

The first locking means may comprise a first tubular member near the bottom edge of the top member and a second tubular member near the top edge of the bottom member, said tubular members being on the second side of the members, said first and second tubular members being aligned when the top and bottom members are in the unfolded position; and a locking pin for passing through the tubular members when the top and bottom members are in the unfolded position. The second locking means may comprise a latch pivotally connected to one of the portions and engagable with the first said side of the one of the members.

An assembly according to another aspect of the invention is for use as a hinge mechanism, particularly adapted for the function mentioned above.

A detailed disclosure following, related to drawings, describes a preferred apparatus according to the invention, which however is capable of expression in apparatus other than those particularly described and illustrated.

DETAILED DISCLOSURE

Figure 1:
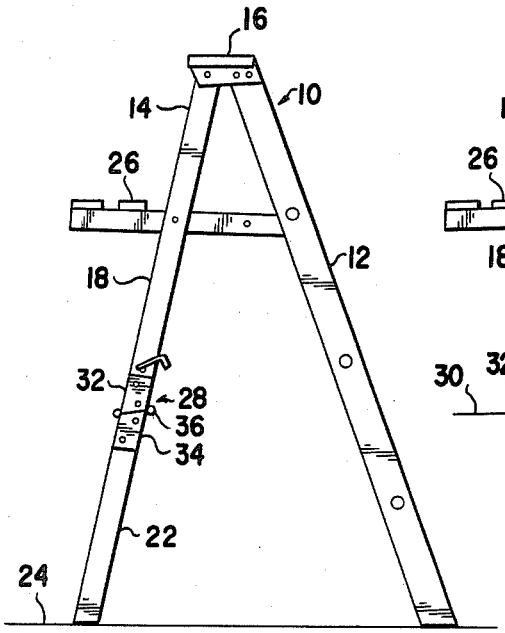
FIG. 1 is a side elevation of a step ladder apparatus according to the invention, with the front legs in an unfolded position.
Figure 2:
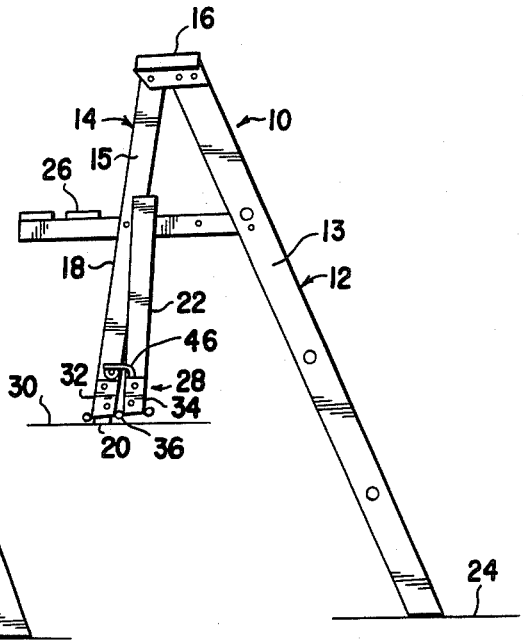
FIG. 2 is a side elevation of the apparatus of FIG. 1, showing the front legs in a folded position.

In FIG. 1, an apparatus 10 according to the invention has rear support 12 for providing a climbing structure in the conventional manner. The apparatus 10 includes front support 14 hingedly connected to rear support 12 by a connecting member 16. Rear support 12 has a pair of legs 13. Front support 14 has a pair of legs 15, each leg 15 having an upper portion 18 with a bottom end 20 (shown in FIG. 2) and a lower portion 22. In FIG. 1, the rear support 12 and each lower portion 22 rest upon a first surface 24. The apparatus 10 includes a work platform 26 which is releasably engagable with the rear support 12 and hingedly connected to front support 14. The apparatus 10 also includes a hinge assembly shown generally at 28. In FIG. 1, hinge assembly 28 is shown in the unfolded position. In FIG. 2, hinge assembly 28 is shown in the folded position to allow bottom end 20 of each upper portion 18 to rest upon a second surface 30 which is raised above the first surface 24, upon which the rear support 12 rests.

Figure 3:
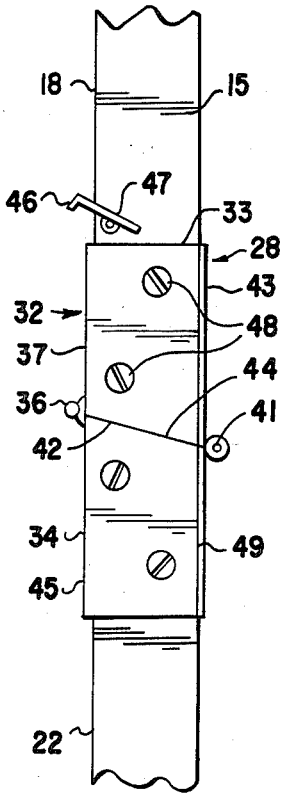
FIG. 3 is an enlarged, fragmentary side elevation of a stepladder showing the hinge means according to the invention in an unfolded position.
Figure 4:
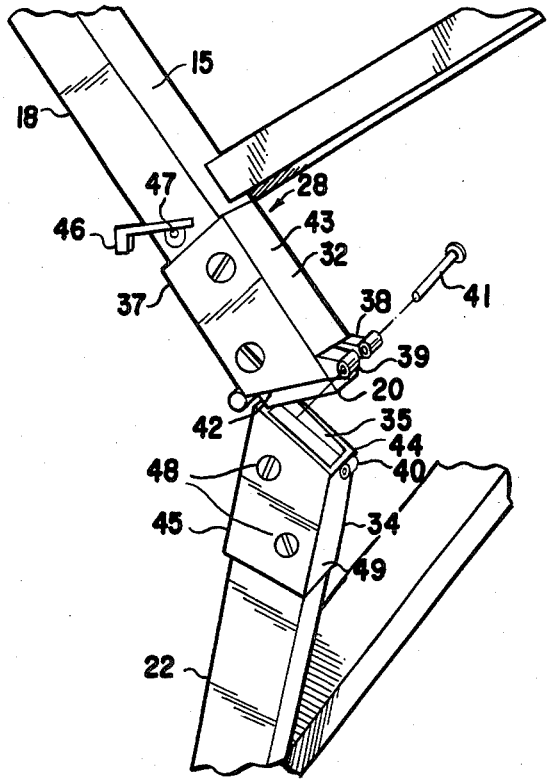
FIG. 4 is an enlarged, fragmentary perspective view of the stepladder showing the hinge means in a partially unfolded position.

In FIG. 3, hinge assembly 28 is shown in the unfolded position. Hinge assembly 28 includes a top member 32 being a rectangular tube having a first side 37, a second side 43 and a first recess 33, shown in FIG. 3, to receive an upper portion 18. Hinge assembly 28 also includes a bottom member 34 having a first side 45, a second side 49 and a second recess 35, shown in FIG. 4, to receive lower portion 22. Each of said members 32 and 34 are hingedly connected together by hinge 36 so as to permit the members to hinge between an unfolded position as shown in FIG. 3, a partially folded position as shown in FIG. 4 and a folded position as shown in FIG. 2. The top member has a bottom edge 42 and the bottom member has a top edge 44, the edges being in contact when the hinge assembly is in the unfolded position of FIG. 3 and extends at an acute angle to sides 37, 43, 45 and 49.

Referring to FIG. 4, top member 32 is located on upper portion 18 such that bottom end 20 of upper portion 18 projects beyond top member 32. Bottom member 34 is located on lower portion 22 such that the latter extends beyond the former, thus forming a pocket to receive the bottom end 20 of upper portion 18 when the front support 14 is in the unfolded position to stabilize the front support 14.

A first locking means comprises a pair of spaced apart first tubular members 38 and 39 located near bottom edge 42 of top member 32, and a second tubular member 40 located near top edge 44 of bottom member 34. The pair of first tubular members 38 and 39 and the second tubular member 40 are aligned when the top and bottom members 32 and 34 are in the unfolded position so that second tubular member 40 is located within the space between first tubular members 38 and 39. A locking pin 41, shown best in FIG. 4, is used to pass through first tubular members 38 and 39 and second tubular member 40 when the top and bottom members 32 and 34 are in the unfolded position of FIG. 3, to lock the top and bottom members 32 and 34.

A second locking means comprises a latch 46 pivotally connected to upper portion 18 at 47 and is engagable with the bottom member 34 when the front support means 14 is in the folded position of FIG. 2.

Top and bottom members 32 and 34 have apertures therein for receiving screws 48 as shown in FIGS. 3 and 4 or nails for securing the members 32 and 34 to the upper and lower portions 18 and 22 respectively.

In operation, the apparatus 10 can be used in two manners. Firstly, the user can employ the apparatus 10 as a conventional step ladder wherein the front and rear supports both rest on the same surface. The user would open the apparatus 10 by pulling the front support 14 from the rear support 12. The user would ensure that the locking pin 41 was secured through first tubular members 38 and 39 and second tubular member 40 to lock the front support 14 in the unfolded position. The user may wish to employ the apparatus in an unconventional manner, wherein the bottom end 20 of each upper portion 18 rests upon a second surface 30 which is raised above a first surface 24 as shown in FIG. 2. He would remove the locking pin from tubular members 38, 39 and 40 and swing the lower portion 22 about hinge 36 to the position shown in FIG. 2 so that hinge assembly 28 is in the folded position. The user would then engage latch 46 with bottom member 34 to lock front support means 14 in the folded position.

I claim:

1. A step ladder apparatus which is convertible for resting on a flat surface or adjacent first and second surfaces wherein the second surface is raised above the first surface, the step ladder apparatus comprising:

(a) rear support means for providing a climbing structure;

(b) front support means including a pair of spaced-apart front support legs for retaining the rear support means in a substantially erect position, said front support means being hingedly connected to the rear support means, each of the legs including an upper portion with a bottom end and a lower portion with a top end;

(c) hinge means for hingedly connecting the upper and lower portions together, the hinge means including a top member having a first recess to receive the upper portion and a bottom member having a second recess to receive the lower portion, each of the members having opposite first and second sides, the members being hingedly connected together on the first said sides of the members so as to permit the members to hinge between an unfolded position where the recesses are aligned and a folded position where the recesses are not aligned; and (d) wherein the upper and lower portions and their respective members are relatively positioned so that each of the upper portions projects beyond the top member to expose the bottom end of each said upper portion and each of the bottom members projects beyond the top of the lower portions to provide a pocket to receive the bottom end of the respective upper portion when the step ladder apparatus is in the unfolded position, whereby the bottom ends can rest on the first surface when the step ladder apparatus is resting adjacent the first and second surfaces.

2. A step ladder apparatus as claimed in claim 1, further comprising first locking means for securing the members in the unfolded position.

3. A step ladder apparatus as claimed in claim 1, further comprising second locking means for securing the members in the folded position.

4. A step ladder apparatus as claimed in claim 1, wherein the members are rectangular tubes.

5. A step ladder apparatus as claimed in claim 1, wherein the top member has a bottom edge and the bottom member has a top edge, the edges being in contact and extending at an acute angle with said first and second sides when the front support means is unfolded.

6. A step ladder apparatus as claimed in claim 5, wherein the first locking means comprises at least one first tubular member near the bottom edge of the top member and a second tubular member near the top edge of the bottom member, said tubular members being on the second side of the members, said first and second tubular members being aligned when the top and bottom members are in the unfolded position; and a locking pin for passing through the tubular members when the top and bottom members are in the folded position.

7. A step ladder apparatus as claimed in claim 3 wherein the second locking means comprises a latch pivotally connected to one of the portions and engagable with the first said side of one of the members.

8. A step ladder apparatus as claimed in claim 1, wherein the bottom end of the upper portion of each of the front support legs is flat and horizontal when the ladder apparatus is positioned for use in the folded position.

* * * * *